US011391159B2

(12) United States Patent
Yamashita

(10) Patent No.: US 11,391,159 B2
(45) Date of Patent: Jul. 19, 2022

(54) BLADE AND ROTARY MACHINE HAVING THE SAME

(71) Applicant: MITSUBISHI HEAVY INDUSTRIES, LTD., Tokyo (JP)

(72) Inventor: Satoshi Yamashita, Tokyo (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 242 days.

(21) Appl. No.: 16/690,610

(22) Filed: Nov. 21, 2019

(65) Prior Publication Data

US 2020/0270996 A1 Aug. 27, 2020

(30) Foreign Application Priority Data

Feb. 27, 2019 (JP) ..... JP2019-033449

(51) Int. Cl.
*F01D 5/14* (2006.01)
*F04D 29/32* (2006.01)
*F04D 29/54* (2006.01)

(52) U.S. Cl.
CPC ..... *F01D 5/145* (2013.01); *F04D 29/324* (2013.01); *F04D 29/544* (2013.01); *F05D 2240/121* (2013.01); *F05D 2240/301* (2013.01); *F05D 2240/303* (2013.01); *F05D 2240/304* (2013.01); *F05D 2240/307* (2013.01); *F05D 2250/70* (2013.01)

(58) Field of Classification Search
CPC ..... F01D 5/145; F04D 29/324; F04D 29/544; F04D 29/682; F04D 29/684
See application file for complete search history.

(56) References Cited

U.S. PATENT DOCUMENTS

2013/0318973 A1 12/2013 Takahashi et al.
2016/0245091 A1* 8/2016 Kupratis ..... F01D 5/146
2017/0175676 A1 6/2017 Murooka et al.
2017/0298742 A1* 10/2017 Johnson ..... F01D 5/20
2017/0328206 A1* 11/2017 Auxier ..... F04D 29/542

FOREIGN PATENT DOCUMENTS

JP 2013-249811 12/2013
JP 2016-118165 6/2016
JP 2017-190776 10/2017

* cited by examiner

*Primary Examiner* — Sabbir Hasan
(74) *Attorney, Agent, or Firm* — Wenderoth, Lind & Ponack, L.L.P.

(57) ABSTRACT

A blade includes: an airfoil portion having a pressure surface and a suction surface each of which extends between a base end and a tip end along a blade height direction between a leading edge and a trailing edge; and an internal passage passing through an inside of the airfoil portion, the internal passage having a first opening end opening to one of the pressure surface or the suction surface and a second opening end which is positioned closer to the tip end than the first opening end in the blade height direction and opening to a surface of the airfoil portion. When L is a length from the base end to the tip end in the blade height direction, a distance from the base end to the first opening end in the blade height direction is not less than zero and not greater than 0.3 L.

5 Claims, 12 Drawing Sheets

BLADE AND ROTARY MACHINE HAVING THE SAME

TECHNICAL FIELD

The present disclosure relates to a blade and a rotary machine having the same.

BACKGROUND ART

With regard to a blade to be applied to a machine such as a rotary machine, separation of a flow may occur in the vicinity of the blade surface of the blade, depending on the operation conditions or the like. When separation of a flow occurs, work on the blade surface decreases, which may lead to deterioration of the performance or operation efficiency of the machine. Thus, it is necessary to design the airfoil so as to reduce the loss generated by separation of the flow or the like.

For instance, Patent Document 1 discloses a blade used for a turbine engine. A flow passage (channel) is disposed inside the airfoil portion of the blade. A gas extraction inlet disposed on the suction surface and the tip end of the airfoil portion is in communication via the flow passage. Furthermore, as a part of the air flow that flows along the airfoil portion is sucked into the flow passage inside the airfoil portion via the gas extraction inlet, separation of the air flow from the blade surface is reduced.

CITATION LIST

Patent Literature

Patent Document 1: JP2017-190776A

SUMMARY

As described in Patent Document 1, by taking a part of the flow near the blade surface into the internal passage of the airfoil, it could be possible to reduce separation of the flow from the blade surface. Furthermore, in order to suppress such separation more effectively, it is desirable to suitably set the position or the like of the intake port (in Patent Document 1, the gas extraction inlet) on the bade surface more suitably.

In view of the above, an object of at least one embodiment of the present invention is to provide a blade and a rotary machine having the same, whereby it is possible to suppress separation that may occur in the vicinity of the blade surface effectively.

(1) According to at least one embodiment of the present invention, a blade includes: an airfoil portion having a pressure surface and a suction surface each of which extends between a base end and a tip end along a blade height direction between a leading edge and a trailing edge; and an internal passage passing through an inside of the airfoil portion, the internal passage having a first opening end opening to one of the pressure surface or the suction surface and a second opening end being positioned closer to the tip end than the first opening end in the blade height direction and opening to a surface of the airfoil portion. When L is a length from the base end to the tip end in the blade height direction, a distance from the base end to the first opening end in the blade height direction is not less than zero and not greater than 0.3 L.

In some cases, separation of the flow in the vicinity of the blade surface in a rotary machine tends to occur relatively in a region at the side of the base end of the airfoil portion (e.g. the region within 30% from the base end in the blade height direction).

In this regard, with the above configuration (1), the internal passage passing through the inside of the airfoil portion includes a first opening end which opens to the blade surface (pressure surface or suction surface) at a position where the distance from the base end in the blade height direction is not greater than 0.3 L, and a second opening end which is positioned closer to the tip end than the first opening end in the blade height direction and which opens to the surface of the airfoil portion. Thus, when the blade rotates about the rotor center axis, in the above described internal passage, a pressure increase is caused by a centrifugal force (pumping pressure increase) due to the radius difference between the first opening end at the radially inner side (at the side of the base end) and the second opening end at the radially outer side (at the side of the tip end). Accordingly, in the internal passage, a flow that flows from the first opening end at the radially inner side to the second opening end at the radially outer side is generated. Thus, it is possible to take the flow in the vicinity of the blade surface where the first opening end is provided (that is, the region near a position whose distance from the base end is not greater than 0.3 L, where separation is likely to occur) into the internal passage from the first opening end, and thereby it is possible to suppress separation that may occur in the vicinity of the blade surface effectively. Therefore, with the above configuration (1), it is possible to reduce the separation region on the blade surface, and suppress deterioration of the efficiency of the rotary machine.

(2) In some embodiments, in the above configuration (1), the first opening end opens to the suction surface.

With regard to a blade of a rotary machine, in some cases, separation of the flow is likely to occur at the suction surface side, depending on the operation conditions and load on the blade rows. In this regard, with the above configuration (2), the first opening end of the internal passage is disposed at the suction surface side, and thus it is possible to take in the flow in the vicinity of the suction surface from the first opening end by utilizing the above described pumping effect, and thereby suppress separation of the flow that may occur in the vicinity of the suction surface of the blade effectively.

(3) In some embodiments, in the above configuration (1) or (2), the internal passage includes: a radial-directional passage portion extending along the blade height direction; and an intake portion extending between a base-end side end of the radial-directional passage portion and the first opening end. When seen from the blade height direction, an extension direction of the intake portion forms an angle of not greater than 45 angular degrees with a portion of a tangent to the one of the pressure surface or the suction surface at the first opening end, the portion being disposed at a trailing edge side with respect to the first opening end.

With the above configuration (3), the internal passage includes the radial-directional passage portion extending in the blade height direction, and thereby the fluid flowing into the internal passage is likely to be pressurized effectively by the above described pumping effect. Thus, it is possible to take in the flow in the vicinity of the blade surface effectively via the first opening end, and suppress separation that may occur in the vicinity of the blade surface effectively.

Furthermore, with the above configuration (3), when seen from the blade height direction, the extension direction of the intake portion extending between the base-end side end of the radial-directional passage portion and the first opening end forms an angle of not greater than 45 angular degrees with the above described tangent. That is, the intake portion has a shape along the blade surface (suction surface or pressure surface) at the position of the first opening end, and thus it is possible to take the fluid flowing in the vicinity of the blade surface smoothly into the internal passage via the intake portion.

(4) In some embodiments, in any one of the above configurations (1) to (3), the first opening end has a plurality of holes opening to the one of the pressure surface or the suction surface.

With the above configuration (4), the first opening end of the internal passage has a plurality of holes that open to the blade surface (pressure surface or suction surface), and thus it is possible to take in the flow of the fluid from a broader region near the blade surface via the plurality of holes. Thus, it is possible to suppress separation of the flow that may occur in the vicinity of the blade surface more effectively.

(5) In some embodiments, in any one of the above configurations (1) to (4), the internal passage includes a radial-directional passage portion extending along the blade height direction, and when $t_{max}$ is a maximum blade thickness of the airfoil portion at a position of the tip end in the blade height direction, the radial-directional passage portion has a blade-thickness directional length of not smaller than 0.3 $t_{max}$ and not greater than 0.7 $t_{max}$.

With the above configuration (5), with the blade-thickness directional length of the radial-directional passage portion being not greater than 0.3 $t_{max}$, it is possible to ensure the flow-passage cross sectional area of the radial-directional passage portion and obtain the above described pumping effect suitably, whereby it is possible to take the flow in the vicinity of the blade surface into the internal passage via the first opening end suitably. Furthermore, with the above configuration (5), with the blade-thickness directional length of the radial-directional passage portion being not greater than 0.7 $t_{max}$, it is possible to maintain a suitable strength of the airfoil portion.

(6) In some embodiments, in any one of the above configurations (1) to (5), the internal passage includes a radial-directional passage portion extending along the blade height direction, and when $t_{max}$ is a maximum blade thickness of the airfoil portion at a position of the tip end in the blade height direction, the radial-directional passage portion has a flow-passage cross sectional area whose equivalent diameter is not smaller than 0.7 $t_{max}$.

With the above configuration (6), since the radial-directional passage portion has a flow-passage cross sectional area whose equivalent diameter is 0.7 $t_{max}$, it is possible to increase the flow-passage cross sectional area, whereby it is possible to achieve the above described pumping effect effectively from the increased flow rate of the internal passage, and take the flow in the vicinity of the blade surface into the internal passage effectively via the first opening end.

(7) In some embodiments, in any one of the above configurations (1) to (6), the internal passage includes a radial-directional passage portion extending along the blade height direction, and the ratio S1/S3 of the flow-passage cross sectional area S1 of the internal passage at the first opening end to the flow-passage cross sectional area S3 of the radial-directional passage portion or the ratio S2/S3 of the flow-passage cross sectional area S2 of the internal passage at the second opening end to the flow-passage cross sectional area S3 of the radial-directional passage portion is not smaller than 0.8 and not greater than 1.2.

With the above configuration (7), the above described ratio S1/S3 or S2/S3 is close to one. That is, there is no significant difference between the flow-passage cross sectional area S1 at the first opening end, the flow-passage cross sectional area S2 at the second opening end, and the flow-passage cross sectional area S3 at the radial-directional passage portion 58, and thus the flow-passage cross sectional area of the internal passage does not change considerably from the first opening end to the second opening end. Thus, it is possible to suppress separation of the flow that may occur in the vicinity of the blade surface effectively while reducing pressure loss in the internal passage.

(8) In some embodiments, in any one of the above configurations (1) to (7), a distance from the base end to the second opening end in the blade height direction is not smaller than 0.9 L and not greater than 1.0 L.

With the above configuration (8), the distance from the base end to the second opening end in the blade height direction is not smaller than 0.9 L and not greater than 1.0 L. That is, since the second opening end is disposed in the range of 10% from the tip end in the blade height direction, it is possible to ensure a larger distance between the first opening end and the second opening end in the blade height direction. Accordingly, in the internal passage, it is possible to increase the centrifugal difference due to the radius difference between the first opening end at the radially inner side (at the side of the base end) and the second opening end at the radially outer side (at the side of the tip end), whereby it is possible to effectively obtain the pressurizing effect from pumping. Thus, thanks to the pumping effect, it is possible to suppress separation that may occur in the vicinity of the blade surface more effectively.

Further, in a rotary machine, a tip leakage flow (tip clearance flow) may occur between the tip end of the rotor blade and the casing. In this regard, with the above configuration (8), the flow taken into the internal passage via the first opening end is discharged from the tip end or the second opening end disposed near the tip end in the blade height direction. Thus, it is possible to suppress the above described leakage flow by utilizing the flow discharged from the second opening end, and improve the efficiency of the rotary machine even further.

(9) In some embodiments, in any one of the above configurations (1) to (8), the second opening end opens to one of the pressure surface or the suction surface.

In a blade of a rotary machine, separation of a flow may occur in a region at the tip-end side (radially outer side) of the position where the first opening end is disposed in the blade height direction. In this regard, with the above configuration (9), the second opening end disposed closer to the tip end than the first opening end in the blade height direction opens to the blade surface (pressure surface or suction surface). Thus, as the flow taken into the internal passage via the first opening end is discharged from the second opening end, a kinetic momentum is supplied to the flow in the vicinity of the blade surface where the second opening end is provided, and thus it is possible to suppress separation of the flow that may occur in the vicinity of the blade surface. Thus, it is possible to suppress separation that may occur in the vicinity of the surface more effectively.

(10) In some embodiments, in the above configuration (9), the internal passage includes: a radial-directional passage portion extending along the blade height direction; and an outflow portion extending between a tip-end side end of the radial-directional passage portion and the second opening end. When seen from the blade height direction, an extension direction of the outflow portion forms an angle of not greater than 45 angular degrees with a portion of a tangent to the one of the pressure surface or the suction surface at the second opening end, the portion being disposed at a leading edge side with respect to the second opening end.

With the above configuration (10), when seen from the blade height direction, the extension direction of the outflow portion extending between the tip-end side end of the radial-directional passage portion and the second opening end forms an angle of not greater than 45 angular degrees with the above described tangent. That is, the outflow portion has a shape along the blade surface (pressure surface or suction surface) at the position of the second opening end, and thus it is possible to cause the flow flowing out from the second opening end via the outflow portion to flow along the blade surface. Accordingly, it is possible to reduce mixing loss of the flow flowing out from the second opening end and the fluid flowing in the vicinity of the blade surface.

(11) In some embodiments, in any one of the above configurations (1) to (10), the internal passage includes: a radial-directional passage portion extending along the blade height direction; and an outflow portion extending between a tip-end side end of the radial-directional passage portion and the second opening end. The outflow portion has a shape whose flow-passage cross sectional area increases gradually toward the second opening end, at a portion including the second opening end.

With the above configuration (11), the outflow portion has a shape whose flow-passage cross sectional area gradually increases toward the second opening end, at a portion including the second opening end, whereby it is possible to supply a fluid having a kinetic momentum to a broad region in the vicinity of the blade surface, via the outflow portion. Thus, it is possible to suppress the above described tip leakage flow effectively, and suppress separation of the flow that may occur in the vicinity of the blade surface effectively.

(12) In some embodiments, in any one of the above configurations (1) to (11), in a cross section at a position of the second opening end in the blade height direction, when C is a chord length of the airfoil portion, a distance between the leading edge and the second opening end in a chord direction of the airfoil portion is greater than zero and not greater than 0.5 C.

Separation of the flow in the vicinity of the blade surface may occur near the center position in the chord direction. In this regard, with the above configuration (12), with the second opening end being disposed relatively upstream in the chord direction, separation in the vicinity of the blade surface is likely to occur at a position downstream of the second opening end. Thus, it is possible to suppress separation of the flow that may occur in the vicinity of the blade surface more effectively.

(13) In some embodiments, in any one of the above configurations (1) to (12), when seen from the blade height direction, the second opening end is positioned downstream of the first opening end in a chord direction of the airfoil portion.

With the above configuration (13), the second opening end is positioned downstream of the first opening end, and thus it is possible to reduce loss of the flow flowing toward the downstream side from the upstream side, and suppress separation that may occur in the vicinity of the blade surface effectively while suppressing deterioration of the efficiency of the rotary machine.

(14) According to at least one embodiment of the present invention, a rotary machine includes the blade according to any one of the above (1) to (13).

With the above configuration (14), the internal passage passing through the inside of the airfoil portion includes a first opening end which opens to the blade surface (pressure surface or suction surface) at a position where the distance from the base end in the blade height direction is not greater than 0.3 L, and a second opening end which is positioned closer to the tip end than the first opening end in the blade height direction and which opens to the surface of the airfoil portion. Thus, when the blade rotates about the rotor center axis, in the above described internal passage, a centrifugal force difference (pumping) is caused by the radius difference between the first opening end at the radially inner side (at the side of the base end) and the second opening end at the radially outer side (at the side of the tip end). Accordingly, in the internal passage, a flow that flows from the first opening end at the radially inner side to the second opening end at the radially outer side is generated. Thus, it is possible to take the flow in the vicinity of the blade surface where the first opening end is provided (that is, a region near a position whose distance from the base end is not greater than 0.3 L, where separation is likely to occur) into the internal passage from the first opening end, and thereby it is possible to effectively suppress separation that may occur in the vicinity of the blade surface. Therefore, with the above configuration (14), it is possible to reduce the separation region on the blade surface, and suppress reduction of the efficiency of the rotary machine.

According to at least one embodiment of the present invention, it is possible to provide a blade and a rotary machine having the same, whereby it is possible to suppress separation that may occur in the vicinity of the blade surface effectively.

DETAILED DESCRIPTION

Embodiments of the present invention will now be described in detail with reference to the accompanying drawings. It is intended, however, that unless particularly identified, dimensions, materials, shapes, relative positions and the like of components described in the embodiments shall be interpreted as illustrative only and not intended to limit the scope of the present invention.

A rotary machine to which a blade according to the embodiment of the present invention is to be applied may be a compressor or a turbine, for instance, or a gas turbine that includes a compressor or a turbine. Firstly, with reference to FIG. 1, the gas turbine to which a blade according to some embodiments is to be applied will be described.

Figure 1:
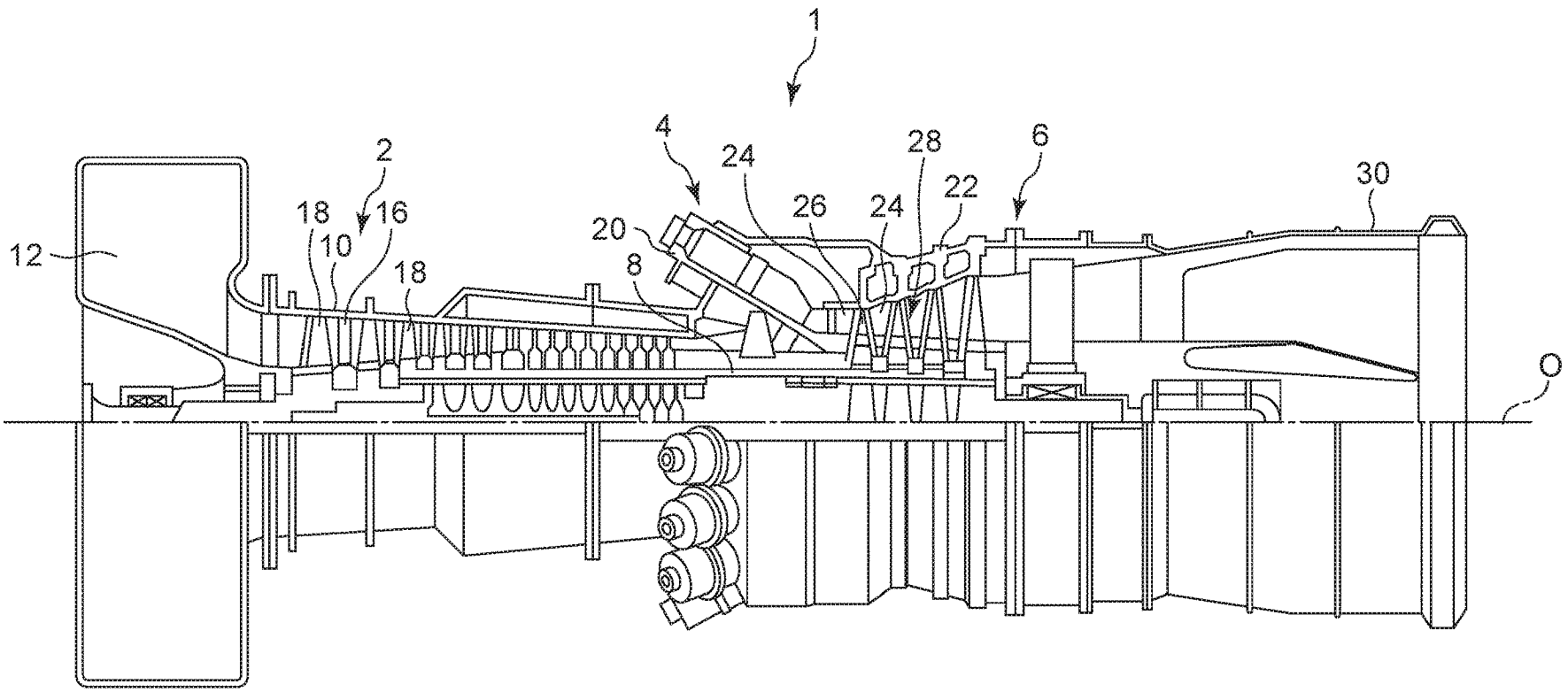
FIG. 1 is a schematic configuration diagram of a gas turbine according to an embodiment.

FIG. 1 is a schematic configuration diagram of a gas turbine according to an embodiment. As depicted in FIG. 1, the gas turbine 1 includes a compressor 2 for producing compressed air, a combustor 4 for producing combustion gas from the compressed air and fuel, and a turbine 6 configured to be rotary driven by combustion gas. In the case of the gas turbine 1 for power generation, a generator (not illustrated) is connected to the turbine 6.

The compressor 2 includes a plurality of stator vanes 16 fixed to the side of the compressor casing 10 and a plurality of rotor blades 18 implanted on the rotor 8 so as to be arranged alternately with the stator vanes 16.

The above compressor 2 is configured to be supplied with air taken in from an air intake 12, and the air flows through the plurality of stator vanes 16 and the plurality of rotor blades 18 to be compressed, and turns into compressed air having a high temperature and a high pressure.

The combustor 4 is configured to be supplied with fuel and the compressed air produced in the compressor 2, and combusts the fuel to produce combustion gas that serves as a working fluid of the turbine 6. As depicted in FIG. 1, the gas turbine 1 includes a plurality of combustors 4 arranged along the circumferential direction around the rotor 8 inside the casing 20.

The turbine 6 has a combustion gas passage 28 formed by a turbine casing 22, and includes a plurality of stator vanes 24 and a plurality of rotor blades 26 disposed in the combustion gas passage 28. The stator vanes 24 and the rotor blades 26 of the turbine 6 are disposed downstream of the combustor 4, with respect to the flow of combustion gas.

The stator vanes 24 are fixed to the side of the turbine casing 22, and a plurality of stator vanes 24 arranged along the circumferential direction of the rotor 8 form a stator vane row. Furthermore, the rotor blades 26 are implanted on the rotor 8, and a plurality of rotor blades 26 arranged along the circumferential direction of the rotor 8 form a rotor blade row. The rotor rows and the vane rows are arranged alternately in the axial direction of the rotor 8.

In the turbine 6, the rotor 8 is rotary driven by combustion gas from the combustor 4 flowing into the combustion gas passage 28 and passing through the plurality of stator vanes 24 and the plurality of rotor blades 26, and thereby a generator coupled to the rotor 8 is driven and electric power is generated. The combustion gas having driven the turbine 6 is discharged outside via the discharge chamber 30.

Hereinafter, the blade according to some embodiments will be described. According to some embodiments, the blade is to be applied to a rotary machine, and configured to be attached to a rotor of the rotary machine and rotate with the rotor. For instance, according to some embodiments, the blade may be a rotor blade 18 of the compressor 2 or a rotor blade 26 of the turbine 6, of the above described gas turbine 1. Hereinafter, the rotor blade 18 of the compressor 2 will be described as a blade according to some embodiments.

Figure 5:
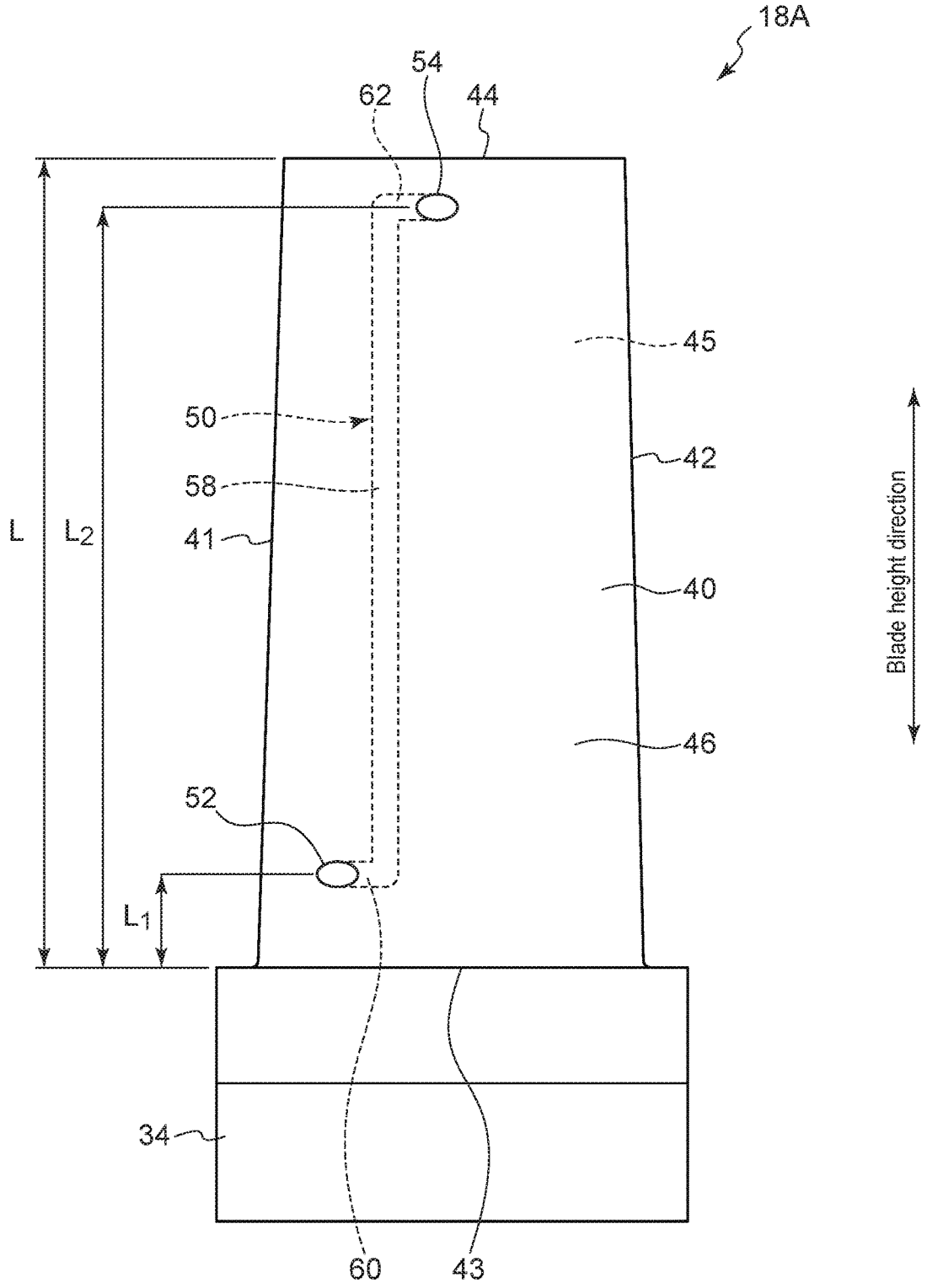
FIG. 5 is a front view of the rotor blade depicted in FIG. 2.
Figure 6:
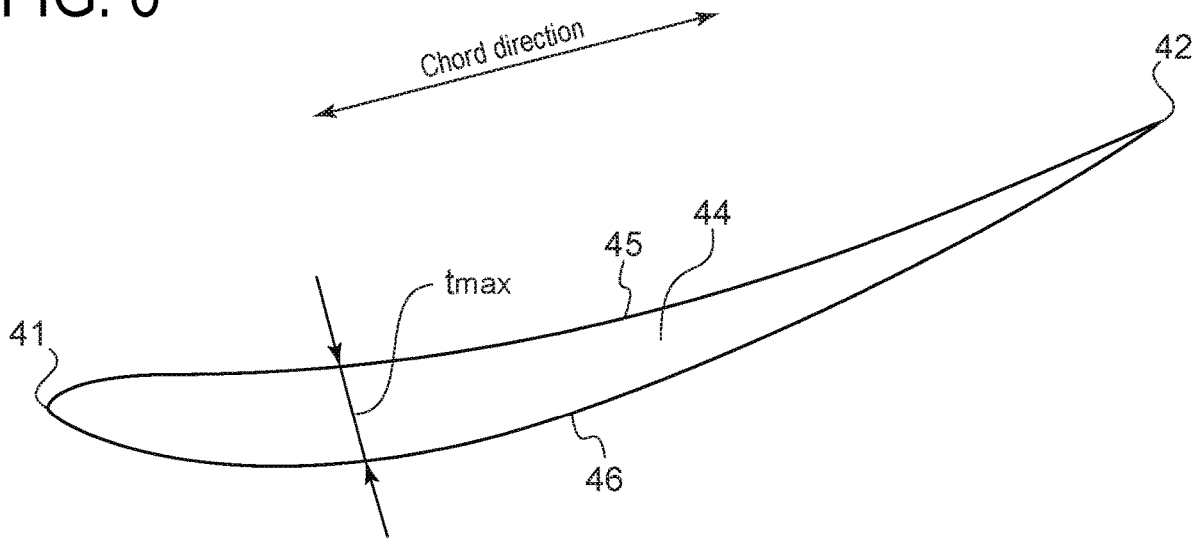
FIG. 6 is a schematic diagram of the tip end of a rotor blade according to an embodiment, as seen from the blade height direction.
Figure 7A:
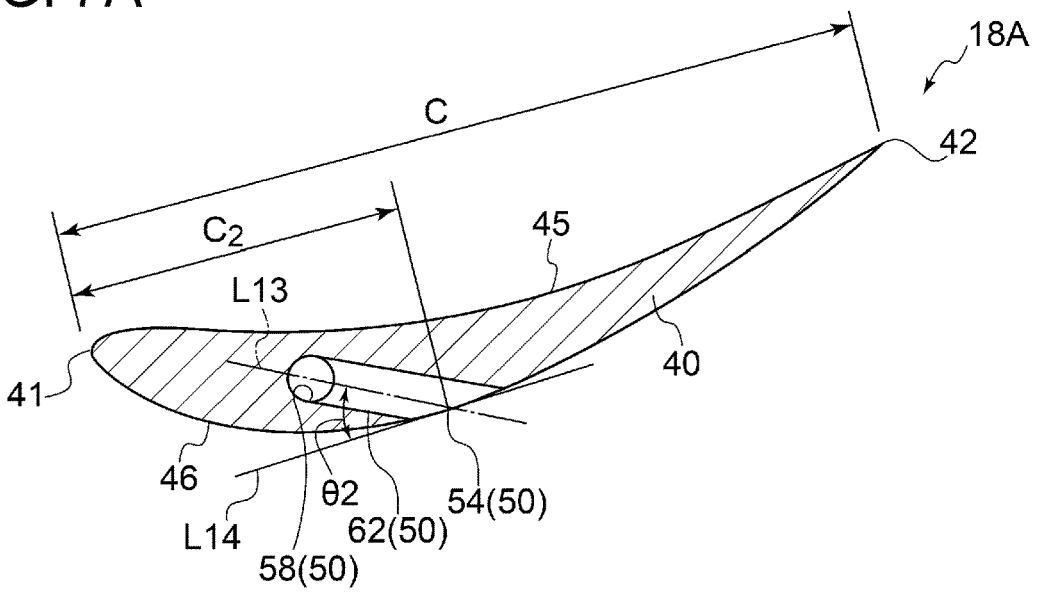
FIG. 7A is a cross-sectional view of the rotor blade depicted in FIG. 2, taken along a direction that is orthogonal to the blade height direction.
Figure 7B:
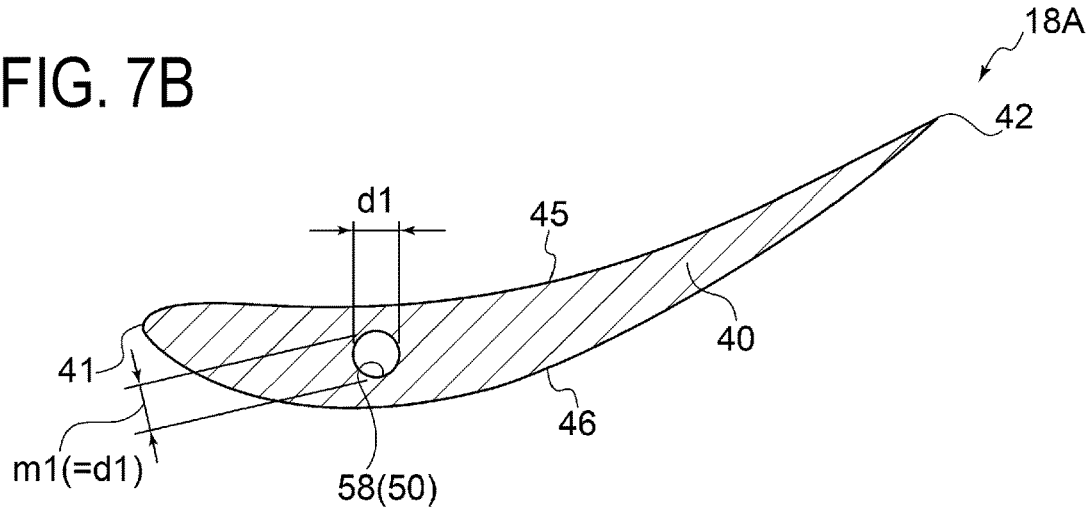
FIG. 7B is a cross-sectional view of the rotor blade depicted in FIG. 2, taken along a direction that is orthogonal to the blade height direction.
Figure 7C:
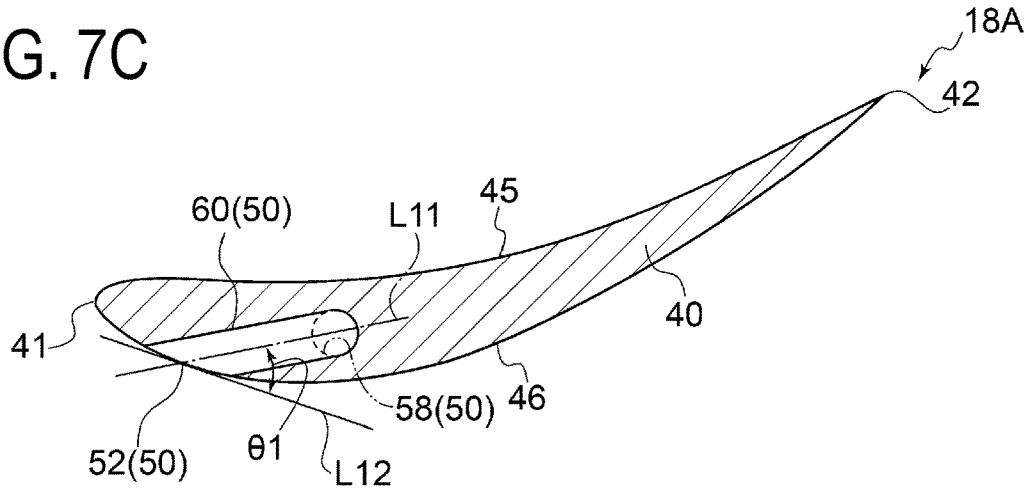
FIG. 7C is a cross-sectional view of the rotor blade depicted in FIG. 2, taken along a direction that is orthogonal to the blade height direction.
Figure 8A:
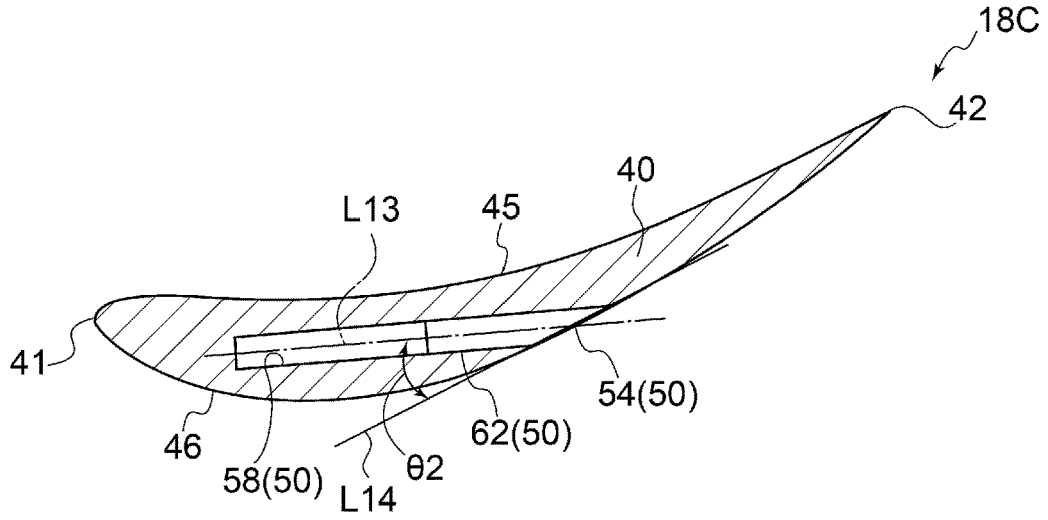
FIG. 8A is a cross-sectional view of the rotor blade depicted in FIG. 4, taken along a direction that is orthogonal to the blade height direction.
Figure 8B:
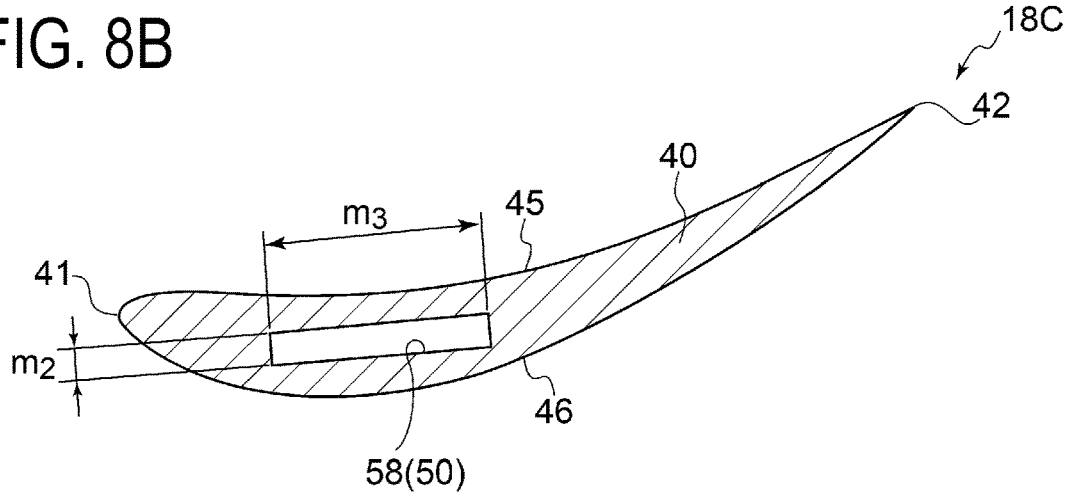
FIG. 8B is a cross-sectional view of the rotor blade depicted in FIG. 4, taken along a direction that is orthogonal to the blade height direction.
Figure 8C:
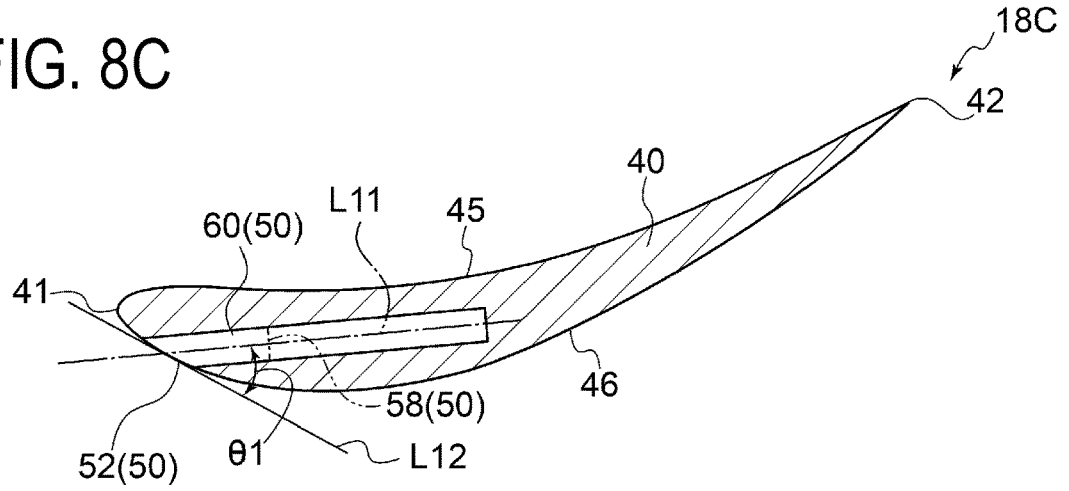
FIG. 8C is a cross-sectional view of the rotor blade depicted in FIG. 4, taken along a direction that is orthogonal to the blade height direction.

FIGS. 2 to 4, and 12 are each a perspective view of the rotor blade 18 (18A to 18D) according to an embodiment. FIG. 5 is a front view of the rotor blade 18A depicted in FIG. 2. FIG. 6 is a schematic diagram of the tip end 44 of the rotor blade 18 according to an embodiment, as seen from the blade height direction. FIGS. 7A to 7C are each a cross-sectional view of the rotor blade 18A depicted in FIG. 2, taken along a direction that is orthogonal to the blade height direction. FIGS. 8A to 8C are each a cross-sectional view of the rotor blade 18C depicted in FIG. 4, taken along a direction that is orthogonal to the blade height direction. FIGS. 13A to 13C are each a cross-sectional view of the rotor blade 18D depicted in FIG. 12, taken along a direction that is orthogonal to the blade height direction.

In the present specification, the blade height direction refers to a direction connecting the base end 43 and the tip end 44 of the airfoil portion 40, and substantially coincides with the radial direction of the rotor in a state where the rotor blade 18 is mounted to the rotor of the compressor 2.

As depicted in FIGS. 2 to 5 and 12, the rotor blade 18 according to some embodiments includes the airfoil portion 40 extending between the base end 43 and the tip end 44, in the blade height direction. The base end 43 of the airfoil portion 40 is connected to the blade root portion 34. The rotor blade 18 is configured to be mountable to the rotor by embedding the blade root portion 34 into the rotor of the compressor 2. The airfoil portion 40 includes a pressure surface 45 and a suction surface 46 that extend between the leading edge 41 and the trailing edge 42 along the blade height direction. When seen from the blade height direction, the pressure surface 45 has a concave shape that is recessed toward the inner side of the airfoil portion 40, and the suction surface 46 has a convex shape that protrudes from the inner side toward the outer side of the airfoil portion 40.

The rotor blade 18 further includes an internal passage 50 that passes through the inside of the airfoil portion 40. The internal passage 50 includes a first opening end 52 which opens to the pressure surface 45 or the suction surface 46, and a second opening end 54 which is positioned closer to the tip end 44 than the first opening end 52 in the blade height direction and which opens to the surface of the airfoil portion 40. In the illustrative embodiments depicted in FIGS. 2 and 4, the first opening end 52 and the second opening end 54 open to the suction surface 46. In the illustrative embodiment depicted in FIG. 3, the first opening end 52 opens to the suction surface 46, and the second opening end 54 opens to the surface of the tip end 44. In the illustrative embodiment depicted in FIG. 12, the first opening end 52 and the second opening end 54 open to the pressure surface 45. In some embodiments, one of the first opening end 52 or the second opening end 54 may open to the suction surface 46, and the other one may open to the pressure surface 45. In some embodiments, the first opening end 52 may open to the pressure surface 45, and the second opening end 54 may open to the surface of the tip end 44.

In the rotor blade 18, when L is the length from the base end 43 to the tip end 44 in the blade height direction (see FIG. 5), the distance L1 (see FIG. 5) from the base end 43 to the first opening end 52 in the blade height direction is not smaller than zero and not greater than 0.3 L.

In the above described embodiment, the internal passage 50 passing through the inside of the airfoil portion 40 includes a first opening end 52 which opens to the suction surface 46 at a position where the distance from the base end 43 in the blade height direction is not greater than 0.3 L, and a second opening end 54 which is positioned closer to the tip end 44 than the first opening end 52 in the blade height direction and which opens to the surface of the airfoil portion 40 (the suction surface 46 or the surface of the tip end 44). Thus, when the rotor blade 18 rotates about the rotor center axis, in the above described internal passage 50, a centrifugal force difference (pump) is caused by the radius difference between the first opening end 52 at the radially inner side (at the side of the base end 43) and the second opening end 54 at the radially outer side (at the side of the tip end 44). Accordingly, in the internal passage 50, a flow that flows from the first opening end 52 at the radially inner side to the second opening end 54 at the radially outer side is generated. Thus, it is possible to take the flow in the vicinity of the suction surface 46 where the first opening end 52 is provided (that is, a region near a position whose distance from the base end 43 is not greater than 0.3 L, where separation is likely to occur) into the internal passage 50 from the first opening end 52, and thereby it is possible to suppress separation that may occur in the vicinity of the suction surface 46 effectively. Therefore, according to the above described embodiment, it is possible to suppress reduction of the work region on the suction surface 46, and suppress deterioration of the efficiency of the compressor 2.

Furthermore, in the rotor blade 18, when L is the length from the base end 43 to the tip end 44 in the blade height direction (see FIG. 5), the distance L2 (see FIG. 5) from the base end 43 to the second opening end 54 in the blade height direction may be not smaller than 0.9 L and not greater than 1.0 L.

In this case, the second opening end 54 is disposed in the range of 10% from the tip end 44 in the blade height direction, and thereby it is possible to ensure a larger distance between the first opening end 52 and the second opening end 54 in the blade height direction. Accordingly, in the internal passage 50, it is possible to increase the centrifugal difference caused by the radius difference between the first opening end 52 at the radially inner side (at the side of the base end 43) and the second opening end 54 at the radially outer side (at the side of the tip end), whereby it is possible to effectively obtain the pressurizing effect of pumping. Thus, thanks to the pumping effect, it is possible to suppress separation that may occur in the vicinity of the suction surface 46 more effectively.

Further, in the compressor 2, a tip leakage flow (tip clearance flow) may occur between the tip end 44 of the rotor blade 18 and the casing. In this regard, according to the above described embodiment, the flow taken into the internal passage 50 via the first opening end 52 is discharged from the tip end 44 or the second opening end 54 disposed near the tip end in the blade height direction. Thus, it is possible to suppress the above described leakage flow by utilizing the flow discharged from the second opening end 54. For instance, by discharging the flow from the second opening end 54 toward the gap between the tip end 44 of the rotor blade 18 and the casing of the compressor 2 and forming a fluid curtain in the gap, it is possible to block and suppress the leakage flow that passes through the gap. Accordingly, it is possible to further improve the efficiency of the compressor 2.

Figure 2:
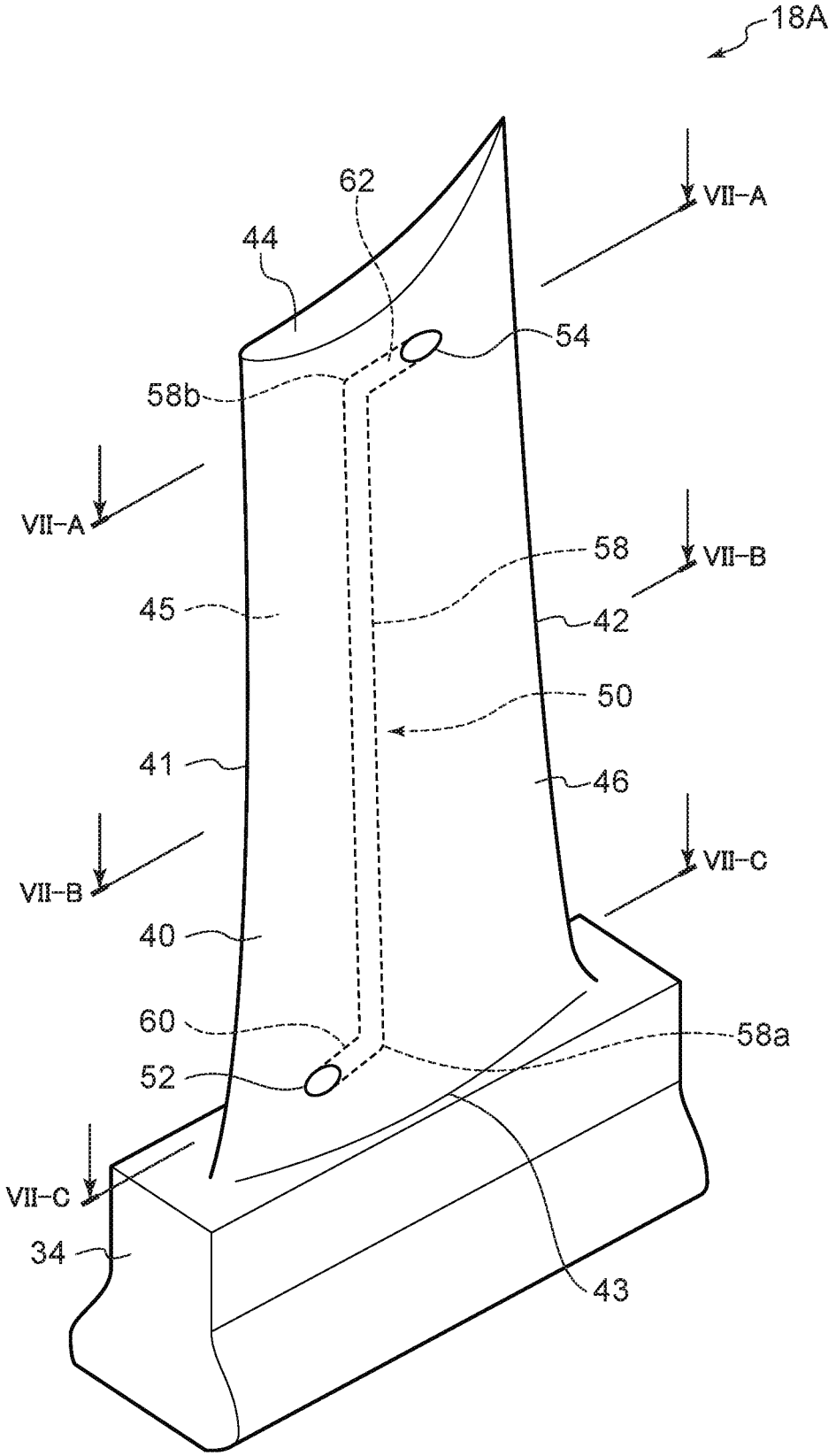
FIG. 2 is a perspective view of a rotor blade according to an embodiment.
Figure 4:
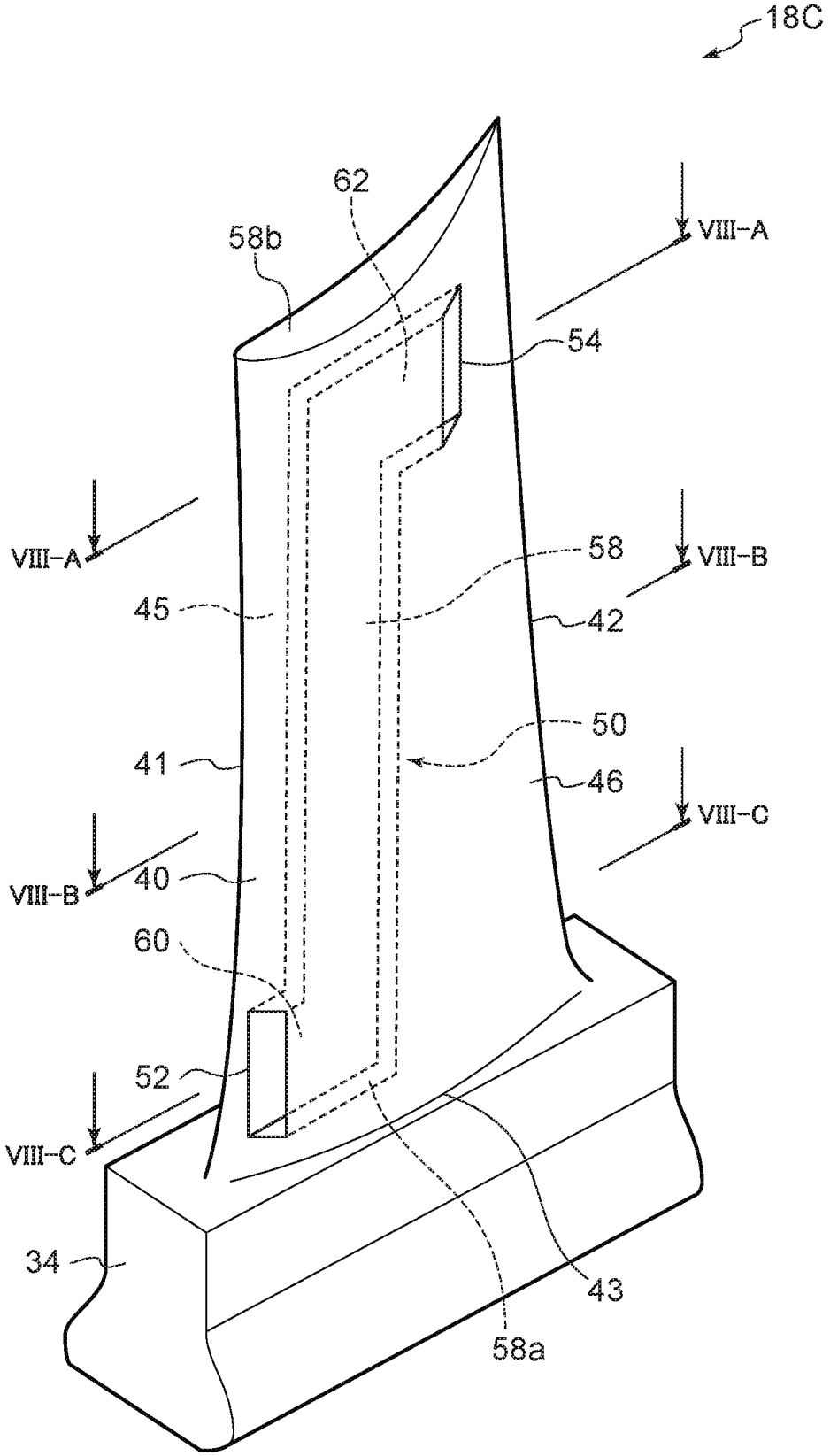
FIG. 4 is a perspective view of a rotor blade according to an embodiment.

As depicted in FIGS. 2 and 4, the second opening end 54 may open to the suction surface 46. In this case, as the flow taken into the internal passage 50 via the first opening end 52 is discharged from the second opening end 54, a kinetic momentum is supplied to the flow in the vicinity of the suction surface 46 where the second opening end 54 is provided, and thus it is possible to suppress separation of the flow that may occur in the vicinity of the suction surface 46 closer to the tip end 44 than the first opening end 52. Thus, it is possible to suppress separation that may occur in the vicinity of the suction surface 46 more effectively.

Figure 12:
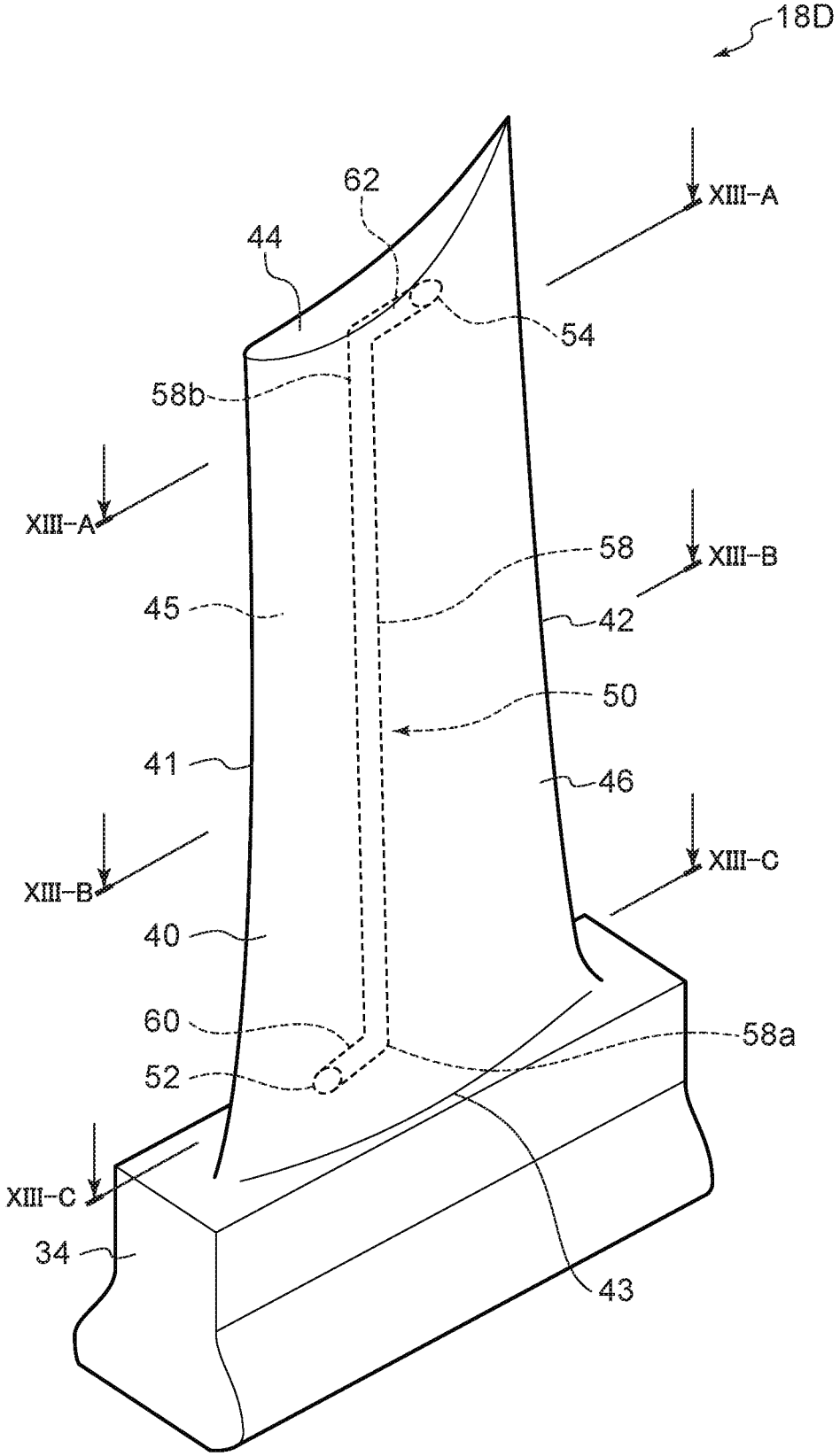
FIG. 12 is a perspective view of a rotor blade according to an embodiment.
Figure 13A:
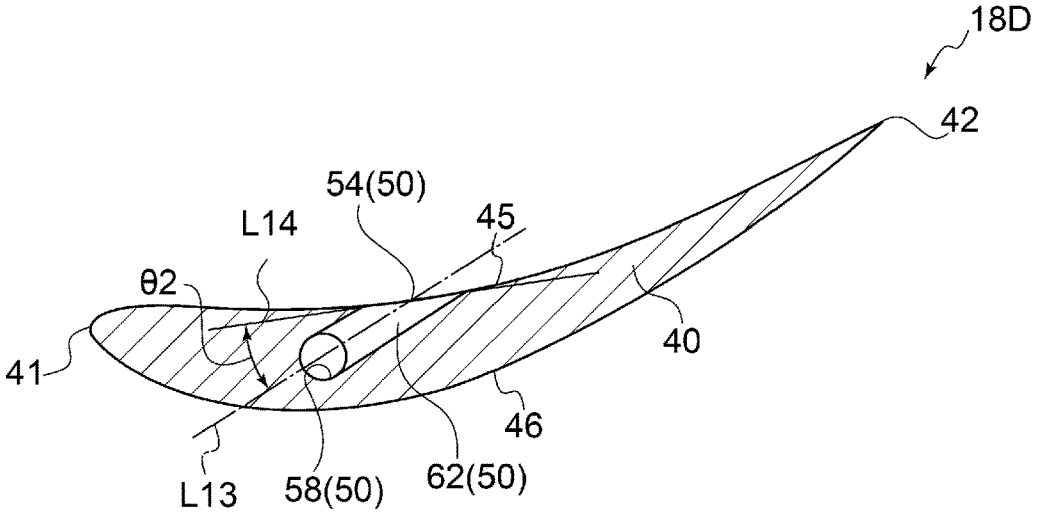
FIG. 13A is a cross-sectional view of the rotor blade depicted in FIG. 12, taken along a direction that is orthogonal to the blade height direction.
Figure 13B:
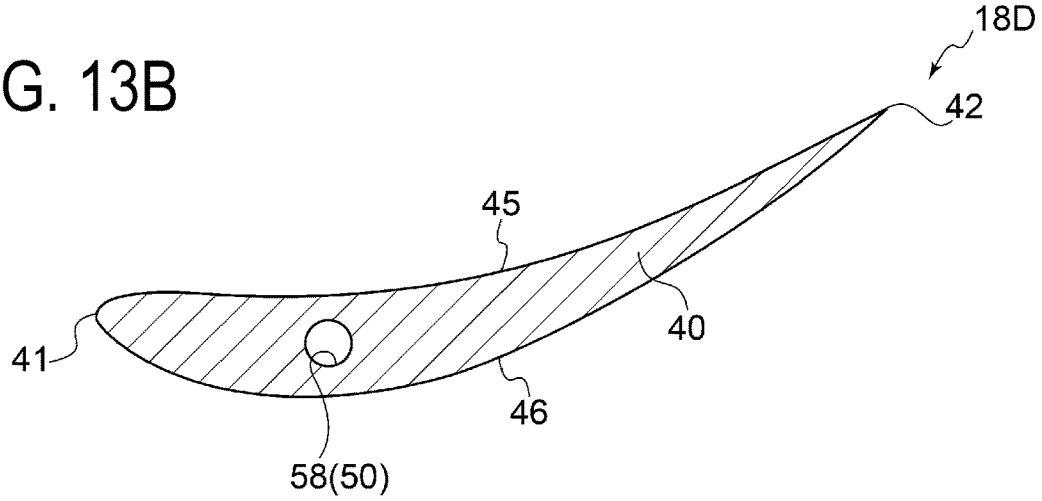
FIG. 13B is a cross-sectional view of the rotor blade depicted in FIG. 12, taken along a direction that is orthogonal to the blade height direction.
Figure 13C:
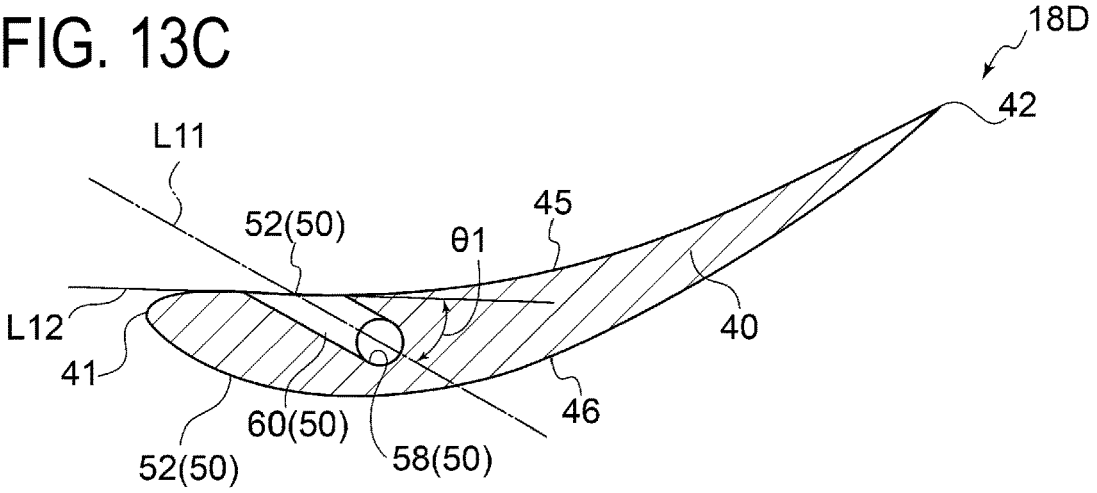
FIG. 13C is a cross-sectional view of the rotor blade depicted in FIG. 12, taken along a direction that is orthogonal to the blade height direction.

Alternatively, as depicted in FIG. 12, the second opening end 54 may open to the pressure surface 45. In this case, as the flow taken into the internal passage 50 via the first opening end 52 is discharged from the second opening end 54, a kinetic momentum is supplied to the leakage flow near the pressure surface 45 where the second opening end 54 is provided, that is, the tip clearance, and thus it is possible to suppress separation of the flow that may occur in the tip clearance portion in the vicinity of the pressure surface 45 closer to the tip end 44 than the first opening end 52. Thus, it is possible to suppress separation that may occur in the vicinity of the pressure surface 45 more effectively.

Figure 3:
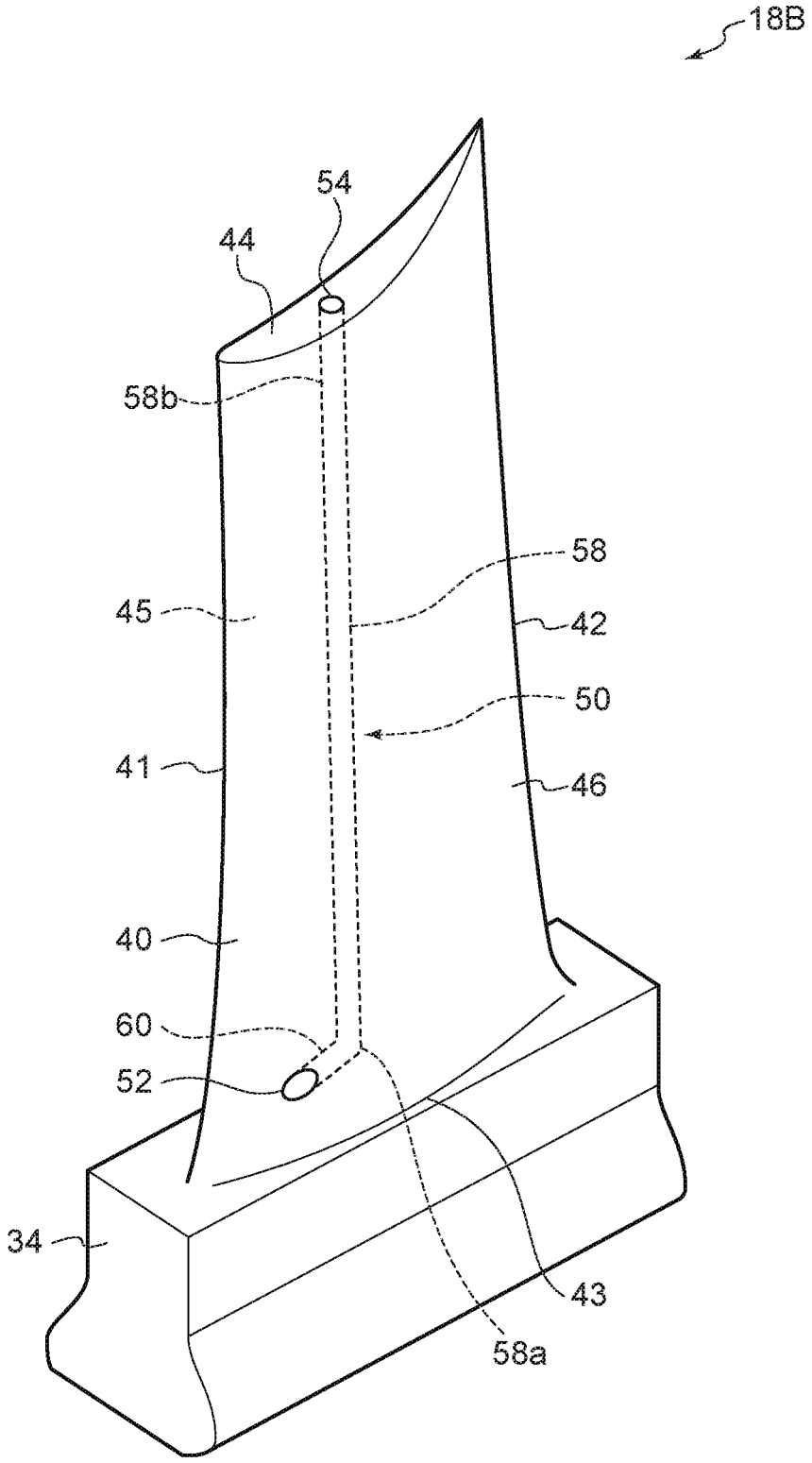
FIG. 3 is a perspective view of a rotor blade according to an embodiment.

Furthermore, as depicted in FIG. 3 for instance, the second opening end 54 may open to the surface of the tip end 44 of the airfoil portion 40. In this case, the flow from the internal passage 50 is more easily discharged from the second opening end 54 opening to the surface of the tip end 44 toward the gap between the tip end 44 and the casing of the compressor 2. Thus, it is possible to suppress the tip clearance flow between the tip end 44 of the rotor blade 18 and the casing effectively.

In some embodiments, in the cross section at the position of the second opening end 54 in the blade height direction, when C is the chord length of the airfoil portion 40 (see FIG. 7A), the distance C2 between the leading edge 41 and the second opening end 54 in the chord direction of the airfoil portion 40 (see FIG. 7A) is greater than zero and not greater than 0.5 C.

FIG. 7A is a schematic cross-sectional view of the airfoil portion 40 at the position of the second opening end 54 in the blade height direction.

Furthermore, the chord direction of the airfoil portion 40 is a direction connecting the leading edge 41 and the trailing edge 42 of the airfoil portion 40, and the chord length is the distance between the leading edge 41 and the trailing edge 42.

Separation of the flow in the vicinity of the blade surface (suction surface 46 or pressure surface 45) may occur near the center position in the chord direction (position of 0.5 C). In this regard, according to the above described embodiment, with the second opening end 54 being disposed relatively upstream in the chord direction, separation in the vicinity of the blade surface is likely to occur at a position downstream of the second opening end 54. Thus, it is possible to suppress separation of the flow that may occur in the vicinity of the blade surface more effectively.

In some embodiments, when seen from the blade height direction, the second opening end 54 is positioned downstream of the first opening end 52 in the chord direction (or, at the side of the trailing edge 42 in the chord direction) of the airfoil portion 40.

In this case, the second opening end 54 is positioned downstream of the first opening end 52, and thus it is possible to reduce loss of the flow flowing toward the downstream side from the upstream side, and suppress separation that may occur in the vicinity of the blade surface effectively while suppressing deterioration of the efficiency of the compressor 2.

Of FIGS. 7A to 7C, 8A to 8C, and 13A to 13C, FIGS. 7A, 8A, and 13A are schematic cross-sectional views of the airfoil portion 40 at the position of the second opening end 54 in the blade height direction (VIIIA-VIIA cross section in FIG. 2, VIIIA-VIIIA cross section in FIG. 4, and XIIIA-XIIIA cross section in FIG. 12). FIGS. 7B, 8B, and 13B are schematic cross-sectional views of the airfoil portion 40 at the position between the first opening end 52 and the second opening end 54 in the blade height direction (VIIB-VIIB cross section in FIG. 2, VIIIB-VIIIB cross section in FIG. 4, and XIIIB-XIIIB cross section in FIG. 12). FIGS. 7C, 8C, and 13C are schematic cross-sectional views of the airfoil portion 40 at the position of the first opening end 52 in the blade height direction (VIIC-VIIC cross section in FIG. 2, VIIIC-VIIIC cross section in FIG. 4, and XIIIC-XIIIC cross section in FIG. 12).

In the illustrative embodiments depicted in FIGS. 2 to 4 and 12, the internal passage 50 includes a radial-directional passage portion 58 extending along the blade height direction (radial direction of the rotor of the compressor 2) inside the airfoil portion 40.

As described above, with the radial-directional passage portion 58 extending in the blade height direction inside the airfoil portion 40, the fluid flowing into the internal passage 50 is likely to be pressurized effectively by the above described pumping effect. Thus, it is possible to take in the flow in the vicinity of the blade surface effectively via the first opening end 52, and suppress separation that may occur in the vicinity of the blade surface effectively.

In the illustrative embodiments depicted in FIGS. 2 to 4 and 12, the internal passage 50 further includes an intake portion 60 that extends between the base-end side end 58*a* of the radial-directional passage portion 58 and the first opening end 52, inside the airfoil portion 40. The intake portion 60 may extend along the chord direction of the airfoil portion 40, when seen from the blade height direction (see FIGS. 7C, 8C, and 13C, for instance). The intake portion 60 can be disposed so as to extend along the flow in the vicinity of the blade surface compared to the radial-directional passage portion 58, and thus it is possible to incorporate the flow in the vicinity of the blade surface into the internal passage 50 smoothly via the intake portion 60.

In the illustrative embodiments depicted in FIGS. 2, 4, and 12, the internal passage 50 further includes an outflow portion 62 that extends between the tip-end side end 58*b* of the radial-directional passage portion 58 and the second opening end 54, inside the airfoil portion 40. The outflow portion 62 may extend along the chord direction of the airfoil portion 40, when seen from the blade height direction (see FIGS. 7A, 8A, and 13A, for instance). The outflow portion 62 can be disposed so as to extend along the flow in the vicinity of the blade surface compared to the radial-directional passage portion 58, and thus it is possible to cause the flow from the internal passage 50 to flow along the blade surface, via the outflow portion 62.

The cross-sectional shape of the internal passage 50 is not particularly limited, and may be a circle, an oval, or a rectangle.

For instance, in the illustrative embodiments depicted in FIGS. 2 and 7A to 7C, or FIGS. 12 and 13A to 13C, the radial-directional passage portion 58, the intake portion 60, and the outflow portion 62 each have a circular cross-sectional shape.

Furthermore, in the illustrative embodiment depicted in FIG. 3, the radial-directional passage portion 58 and the intake portion 60 each have a circular cross-sectional shape.

Furthermore, in the illustrative embodiments depicted in FIGS. 4 and 8A to 8C, the radial-directional passage portion 58, the intake portion 60, and the outflow portion 62 each have a slit-shaped rectangular cross-sectional shape.

In some embodiments, when $t_{max}$ is the maximum blade thickness of the airfoil portion 40 at the position of the tip end 44 in the blade height direction (see FIG. 6), the radial-directional passage portion 58 has a blade-thickness directional length of not smaller than 0.3 $t_{max}$ and not greater than 0.7 $t_{max}$. In FIGS. 7B and 8B, the blade-thickness directional length of the radial-directional passage portion 58 is indicated as m1 and m2, respectively.

In the present specification, the blade thickness refers to the thickness of the airfoil portion 40 in the chord orthogonal direction, and the blade thickness direction refers to the chord orthogonal direction.

As described above, with the blade-thickness directional length of the radial-directional passage portion 58 being not greater than 0.3 $t_{max}$, it is possible to ensure the flow-passage cross sectional area of the radial-directional passage portion 58 and obtain the above described pumping effect suitably, whereby it is possible to take the flow in the vicinity of the blade surface into the internal passage 50 via the first opening end 52. Furthermore, as described above, with the blade-thickness directional length of the radial-directional passage portion 58 being not greater than 0.7 $t_{max}$, it is possible to maintain a suitable strength of the airfoil portion 40.

In some embodiments, the radial-directional passage portion 58 has a flow-passage cross sectional area whose equivalent diameter is not smaller than 0.7 $t_{max}$.

In a case where the radial-directional passage portion 58 has a circular cross-sectional shape, when the diameter of the cross section of the radial-directional passage portion 58 is d1 (see FIG. 7B), the equivalent diameter De of the flow-passage cross sectional area is d1.

Furthermore, in a case where the radial-directional passage portion 58 has a rectangular cross-sectional shape, when the lengths of the two pairs of opposite sides are m2 and m3 (see FIG. 8B), the equivalent diameter De of the flow-passage cross sectional area is represented by an expression $De=4\times m2\times m3/\{2\times(m2+m3)\}$. In general, an equivalent diameter De is represented by an expression $De=4Af/Wp$. Herein, Af is the flow-passage cross sectional area, and Wp is the perimeter of the cross section.

According to the above embodiment, with the radial-directional passage portion 58 having a flow-passage cross sectional area whose equivalent diameter is not smaller than 0.7 $t_{max}$, It is possible to increase the flow-passage cross sectional area, whereby it is possible to achieve the above described pumping effect effectively, and take the flow in the vicinity of the blade surface into the internal passage effectively via the first opening end 52.

In some embodiments, the ratio S1/S3 of the flow-passage cross sectional area S1 of the internal passage 50 at the first opening end 52 to the flow-passage cross sectional area S3 of the radial-directional passage portion 58 is not smaller than 0.8 and not greater than 1.2. Alternatively, the ratio S2/S3 of the flow-passage cross sectional area S2 of the internal passage 50 at the second opening end 54 to the flow-passage cross sectional area S3 of the radial-directional passage portion 58 is not smaller than 0.8 and not greater than 1.2.

Herein, the flow-passage cross sectional areas S1 to S3 are the respective areas of the cross sections taken in a direction orthogonal to the flow direction of the fluid at the respective positions of the internal passage 50 (that is, at the positions of the first opening end 52, the radial-directional passage portion 58, or the second opening end 54).

In the above described case, the ratio S1/S3 or S2/S3 is not smaller than 0.8 and not greater than 1.2, which is a numeral range close to 1.0. In other words, there is no significant difference between the flow-passage cross sectional area S1 at the first opening end 52 and the flow-passage cross sectional area S3 at the radial-directional passage portion 58, or between the flow-passage cross sectional area S2 at the second opening end 54 and the radial-directional passage portion 58. Thus, the flow-passage cross sectional area of the internal passage 50 does not change considerably from the first opening end 52 to the radial-directional passage portion 58, or from the radial-directional passage portion 58 to the second opening end 54. Thus, according to the above embodiment, it is possible to suppress separation of the flow that may occur in the vicinity of the blade surface effectively while reducing pressure loss in the internal passage 50.

In some embodiments, as depicted in FIGS. 7C, 8C, and 13C for instance, when seen from the blade height direction, the extension direction of the intake portion 60 (in the drawings, the direction of line L11) forms angle θ1 of not greater than 45 angular degrees with a portion of a tangent L12 to the pressure surface 45 or the suction surface 46 (suction surface 46 in FIGS. 7C and 8C, and pressure surface 45 in FIG. 13C) at the first opening end 52, the portion being disposed at the side of the trailing edge 42 with respect to the first opening end 52.

In this case, the intake portion 60 has a shape along the blade surface (suction surface 46 in FIGS. 7C and 8C, and pressure surface 45 in FIG. 13C) at the position of the first opening end 52, and thus it is possible to take in the fluid flowing in the vicinity of the blade surface smoothly into the internal passage 50 via the intake portion 60.

In some embodiments, as depicted in FIGS. 7A, 8A, and 13C for instance, when seen from the blade height direction, the extension direction of the outflow portion 62 (in the drawings, the direction of line L13) forms angle θ2 of not greater than 45 angular degrees with a portion of a tangent L14 to the pressure surface 45 or the suction surface 46 (suction surface 46 in FIGS. 7C and 8C, and pressure surface 45 in FIG. 13C) at the second opening end 54, the portion being disposed at the side of the leading edge 41 with respect to the second opening end 54.

In this case, the outflow portion 62 has a shape along the blade surface (suction surface 46 in FIGS. 7C and 8C, and pressure surface 45 in FIG. 13C) at the position of the second opening end 54, and thus it is possible to cause the flow flowing out from the second opening end 54 via the outflow portion 62 to flow along the blade. Accordingly, it is possible to reduce mixing loss of the flow flowing out from the second opening end 54 and the fluid flowing in the vicinity of the blade surface.

Figure 9A:
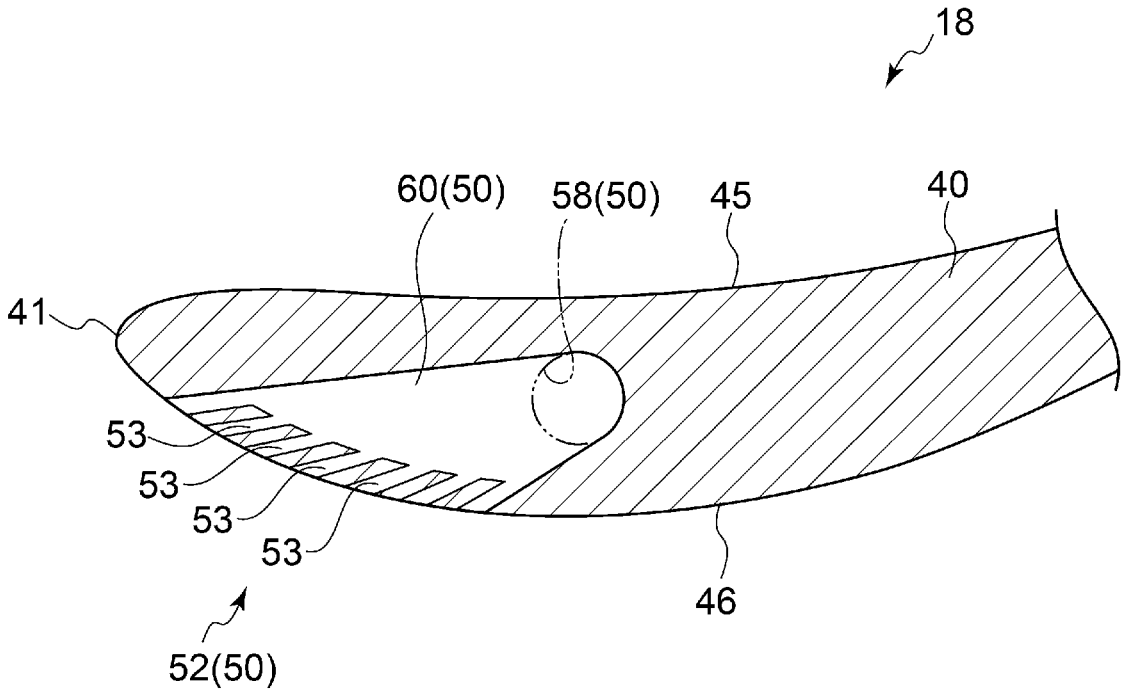
FIG. 9A is a partial schematic cross-sectional view of an airfoil portion of a rotor blade according to an embodiment.
Figure 9B:
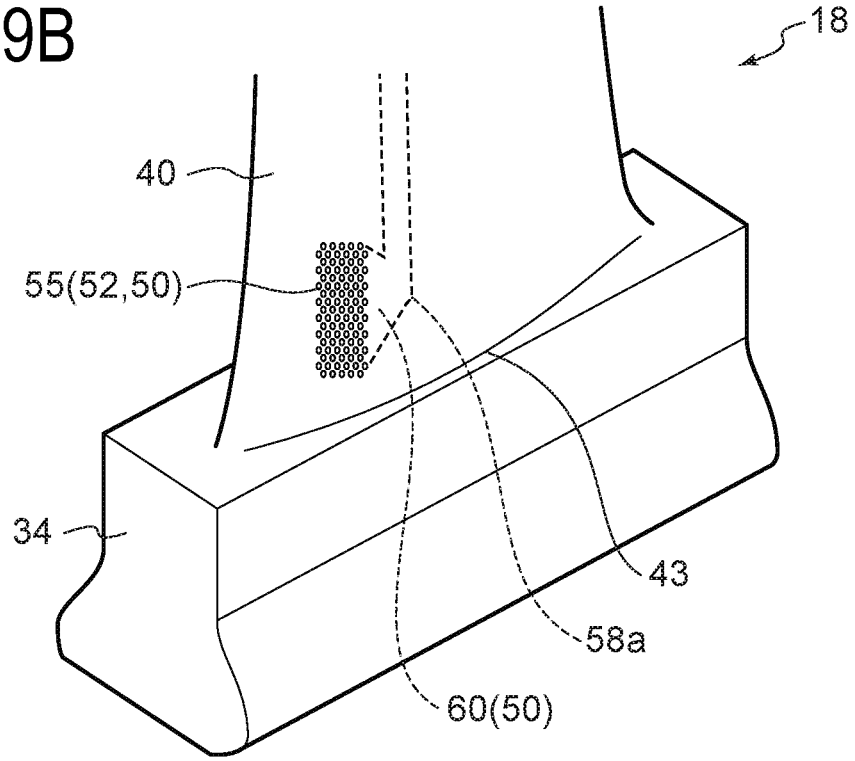
FIG. 9B is a partial schematic cross-sectional view of an airfoil portion of a rotor blade according to an embodiment.

FIGS. 9A and 9B are partial schematic diagrams of the airfoil portion 40 of the rotor blade 18 according to an embodiment, taken along a direction orthogonal to the blade height direction at the position of the first opening end 52.

In some embodiments, as depicted in FIG. 9A for instance, the first opening end 52 may include a plurality of holes 53 that open to the pressure surface 45 or the suction surface 46 (in FIG. 9A, the suction surface 46). Further, in some embodiments, as depicted in FIG. 9B, a perforated plate 55 may be disposed on the first opening end 52. In a case where the first opening end 52 includes a plurality of holes as in the above embodiments, as depicted in FIGS. 9A and 9B, the intake portion 60 may have a tapered portion whose flow-passage cross sectional area gradually increases toward the first opening end 52. As described above, by using both of the first opening end 52 including a plurality of holes and the intake portion 60 having a flow-passage cross sectional area that gradually increases toward the first opening end 52, it is possible to take in the flow of the fluid from a broader region in the vicinity of the blade surface without increasing the opening area excessively. Thus, it is possible to reduce influence on the flow in the vicinity of the blade surface, and suppress deterioration of the efficiency of the compressor.

Figure 10:
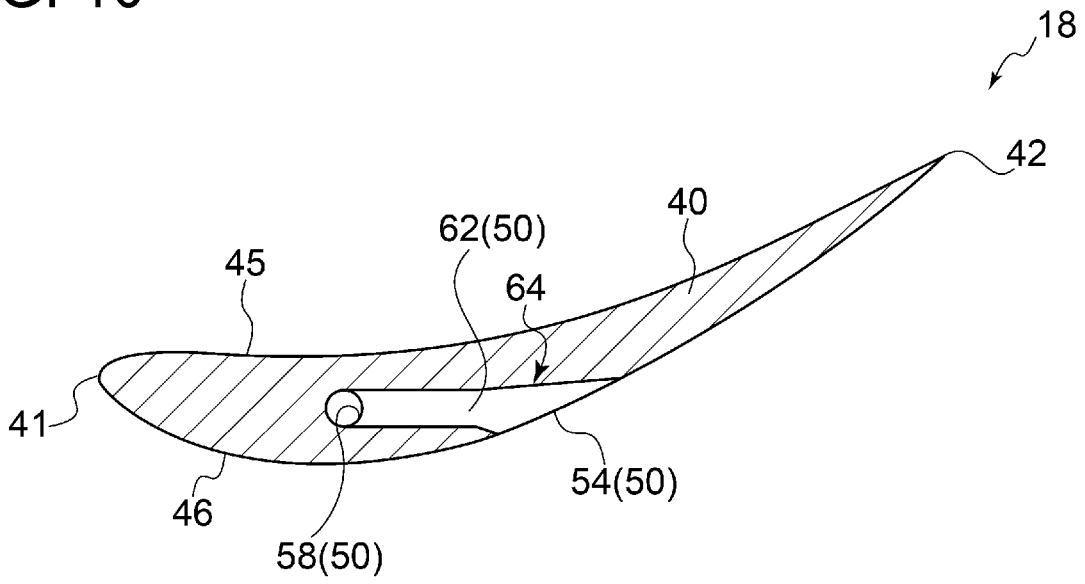
FIG. 10 is a schematic cross-sectional view of an airfoil portion of a rotor blade according to an embodiment.
Figure 11:
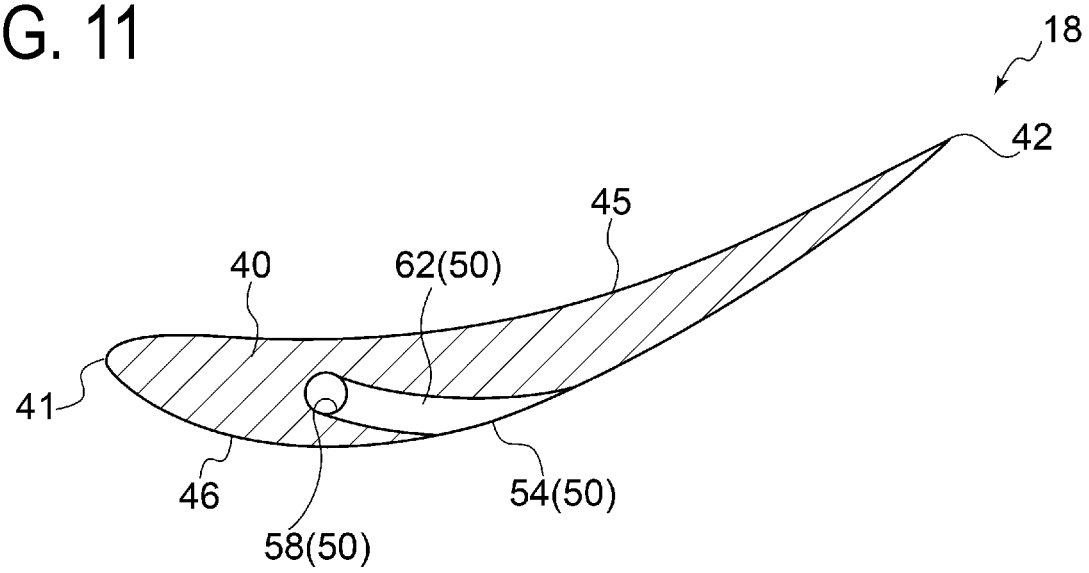
FIG. 11 is a schematic cross-sectional view of an airfoil portion of a rotor blade according to an embodiment.

FIGS. 10 and 11 are schematic diagrams of the airfoil portion 40 of the rotor blade 18 according to an embodiment, taken along a direction orthogonal to the blade height direction at the position of the second opening end 54.

In some embodiments, as depicted in FIG. 10 for instance, the outflow portion 62 includes a diameter-enlarged portion 64 whose flow-passage cross sectional area gradually increases toward the second opening end 54, at a portion including the second opening end 54. As described above, by providing the diameter-enlarged portion 64 whose flow-passage cross sectional area gradually increases toward the second opening end 54, at a portion including the second opening end 54, it is possible to supply a fluid having a kinetic momentum to a broad region in the vicinity of the blade surface, via the outflow portion 62. Thus, it is possible to suppress the above described tip clearance flow effectively, and suppress separation of the flow that may occur in the vicinity of the blade surface effectively.

In some embodiments, as depicted in FIG. 11 for instance, the outflow portion 62 may have a curved shape along the blade surface (in FIG. 11, the suction surface 46). In this case, it is possible to let the flow flowing out from the second opening end 54 via the outflow portion 62 flow along the blade surface. Accordingly, it is possible to reduce mixing loss of the flow flowing out from the second opening end 54 and the fluid flowing in the vicinity of the blade surface.

Embodiments of the present invention were described in detail above, but the present invention is not limited thereto, and various amendments and modifications may be implemented.

Further, in the present specification, an expression of relative or absolute arrangement such as "in a direction", "along a direction", "parallel", "orthogonal", "centered", "concentric" and "coaxial" shall not be construed as indicating only the arrangement in a strict literal sense, but also includes a state where the arrangement is relatively displaced by a tolerance, or by an angle or a distance whereby it is possible to achieve the same function.

For instance, an expression of an equal state such as "same" "equal" and "uniform" shall not be construed as indicating only the state in which the feature is strictly equal, but also includes a state in which there is a tolerance or a difference that can still achieve the same function.

Further, for instance, an expression of a shape such as a rectangular shape or a cylindrical shape shall not be construed as only the geometrically strict shape, but also includes a shape with unevenness or chamfered corners within the range in which the same effect can be achieved.

On the other hand, an expression such as "comprise", "include" and "have" are not intended to be exclusive of other components.

The invention claimed is:

1. A blade, comprising:

an airfoil portion having a pressure surface and a suction surface each of which extends between a base end and a tip end along a blade height direction between a leading edge and a trailing edge; and an internal passage passing through an inside of the airfoil portion, the internal passage having a first opening end opening to one of the pressure surface and the suction surface, and a second opening end being positioned closer to the tip end than the first opening end in the blade height direction and opening to a tip end surface of the airfoil portion, wherein, when L is a length from the base end to the tip end in the blade height direction, a distance from the base end to the first opening end in the blade height direction is not less than zero and not greater than 0.3 L, wherein, when seen from the blade height direction, the second opening end is positioned downstream of the first opening end in a chord direction of the airfoil portion, wherein, the internal passage includes:

a radial-directional passage portion extending along the blade height direction; and an intake portion extending between a base-end side end of the radial-directional passage portion and the first opening end, wherein the first opening end has a plurality of holes opening to the one of the pressure surface and the suction surface, and wherein the intake portion has a flow-passage cross sectional area which gradually increases toward the first opening end.

2. The blade according to claim 1, wherein the first opening end opens to the suction surface.

3. The blade according to claim 1, wherein a distance from the base end to the second opening end in the blade height direction is not smaller than 0.9 L and not greater than 1.0 L.

4. A rotary machine comprising the blade according to claim 1.

5. The blade according to claim 1, wherein the plurality of holes being formed by a perforated plate.

* * * * *